US007427209B2

(12) United States Patent
Bouchan et al.

(10) Patent No.: US 7,427,209 B2
(45) Date of Patent: Sep. 23, 2008

(54) LEVER TYPE ELECTRICAL CONNECTOR

(75) Inventors: Christophe Bouchan, Longjumeau (FR); Patrick Dechelette, Le Plessis Robinson (FR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/858,623

(22) Filed: Sep. 20, 2007

(65) Prior Publication Data

US 2008/0076283 A1 Mar. 27, 2008

(30) Foreign Application Priority Data

Sep. 21, 2006 (EP) ..... 06019735.7

(51) Int. Cl.
*H01R 13/62* (2006.01)

(52) U.S. Cl. ..... 439/372; 439/587

(58) Field of Classification Search ..... 439/372, 439/272, 588, 283, 587, 589
See application file for complete search history.

(56) References Cited

U.S. PATENT DOCUMENTS

| | | | | |
|---|---|---|---|---|
| 5,435,738 | A | 7/1995 | Isohata | |
| 5,735,702 | A | 4/1998 | Hio | |
| 6,241,540 | B1 * | 6/2001 | Tokuwa | 439/157 |
| 6,296,510 | B1 * | 10/2001 | Daniels et al. | 439/372 |
| 6,685,496 | B2 * | 2/2004 | Ookura | 439/372 |
| 6,739,908 | B2 * | 5/2004 | Hamai et al. | 439/587 |
| 6,767,250 | B2 * | 7/2004 | Casses et al. | 439/587 |
| 6,773,278 | B2 * | 8/2004 | Valasek et al. | 439/157 |
| 6,984,149 | B2 * | 1/2006 | Fukuda et al. | 439/587 |
| 7,134,901 | B2 * | 11/2006 | Okura | 439/372 |
| 7,201,609 | B2 * | 4/2007 | Ishikawa | 439/587 |
| 7,252,547 | B2 * | 8/2007 | Nishide | 439/587 |
| 7,300,294 | B2 * | 11/2007 | Fukatsu et al. | 439/157 |
| 7,303,415 | B2 * | 12/2007 | Tyler | 439/157 |
| 2001/0039144 | A1 * | 11/2001 | Osawa et al. | 439/589 |
| 2002/0009922 | A1 * | 1/2002 | Ichio et al. | 439/587 |
| 2003/0181084 | A1 * | 9/2003 | Valasek et al. | 439/157 |
| 2006/0009058 | A1 | 1/2006 | Nagano et al. | |
| 2006/0154511 | A1 * | 7/2006 | Okura | 439/372 |
| 2006/0178049 | A1 * | 8/2006 | Ishikawa | 439/587 |

* cited by examiner

*Primary Examiner*—Ross N Gushi
(74) *Attorney, Agent, or Firm*—Larry I. Golden

(57) ABSTRACT

A lever type electrical connector (1) comprising a connector housing (10) having an annular interfacial seal (4) which extends around the connector housing (10). An annular protecting shroud (5) is arranged surrounding the connector housing (10) without increasing the connector overall dimensions and for being moved in overlapping relationship with said interfacial seal (4) to protect same.

12 Claims, 8 Drawing Sheets

LEVER TYPE ELECTRICAL CONNECTOR

FIELD OF THE INVENTION

The invention relates to an electrical connector (first connector) having a lever for mating and unmating of the first connector with a second complementary electrical connector, and also having an interfacial seal for sealing the gap between the first and the second electrical connectors, when mated.

BACKGROUND OF THE INVENTION

A typical lever-type electrical connector comprises a main connector housing having a cavity for taking up body parts in which terminals are received. The main connector housing has outer wall formations wherein the terminal pins are fixed. The wall formations for fixing the terminal pins are covered by an annular body member which is stuck up onto the lower part of the main connector housing. In order to seal the gaps leading to the terminal pins, an annular seal is provided to surround the main connector housing in the region above the terminal pin wall formations. The annular seal is effective as an interfacial seal between the first electrical connector and the second complementary electrical connector, when the connectors are mated to form an assembly.

Lever-type electrical connectors are used in hard environments, for instance in the automotive sector. As a matter of fact, seals are very sensitive to damages, also before mating the connectors.

SUMMARY OF THE INVENTION

It is an object of the present invention to provide a lever-type electrical connector with protecting features for the interfacial seal.

It is a further object of the present invention to provide a lever-type electrical connector in a compact design.

It is a still further object of the present invention to proved a lever-type electrical connector which has protecting features for the interfacial seal and, when mated with another complementary connector, does not show increased outer dimensions.

The invention is defined in claims 1 and 12.

In principle, an annular shroud is provided to be shifted onto the interfacial seal when the electrical connector (also in partial assembly) is in delivery condition, so that the electrical connector (also in partial assembly) can be shipped and handled without any danger for the interfacial seal. When the lever-type electrical connector is to be mated with a complementary electrical connector, the annular shroud is lifted to uncover the interfacial seal while simultaneously an outer housing member of the complementary electrical connector engages and covers the interfacial seal so that the interfacial seal remains protected all over the time.

The lever of the lever-type electrical connector can take two end positions and any number of intermediate positions. When the connector is in an (open) position ready to be mated with a complementary connector, the position of the lever is termed "starting position". When both connectors are connected together, the position of the lever is termed "final position". In a first embodiment of the invention, the lever and the protective shroud are designed to make coordinated movements. To that end, the lever is shaped to include a curved guideway which cooperates with a follower cam on the shroud, and the shroud is lifted (or retracted) when the lever is rotated from its starting position into its final position, and is lowered (or advanced), when the lever is rotated from its final position into its start position.

The complementary electrical connector to which the lever-type electrical connector is to be mated has an outer housing member with a pair of cog or pin projections on the outer side of the housing member. The lever of the lever-type electrical connector has a pair of curved grooves which can be coupled to the cog or pin projections and cooperates therewith so as to draw the complementary electrical connector in direction of the lever-type electrical connector, when the lever is rotated from its starting position in its final position, and separate the complementary electrical connector from the lever-type electrical connector, when the lever is rotated from its final position into its starting position. The outer housing member has a top side facing the lever-type electrical connector, particularly the shroud and the interfacial seal of the connector. In a second embodiment of the invention, the lifting movement of the shroud is controlled by the relative movement of the outer housing of the complementary connector to the shroud of the lever-type electrical connector. The return movement of the shroud can be controlled by springs.

Other objects, features and advantages of the invention will be apparent from the following detailed description taken in connection with the accompanying drawings.

DETAILED DESCRIPTION OF THE PREFERRED EMBODIMENTS

Figure 4:
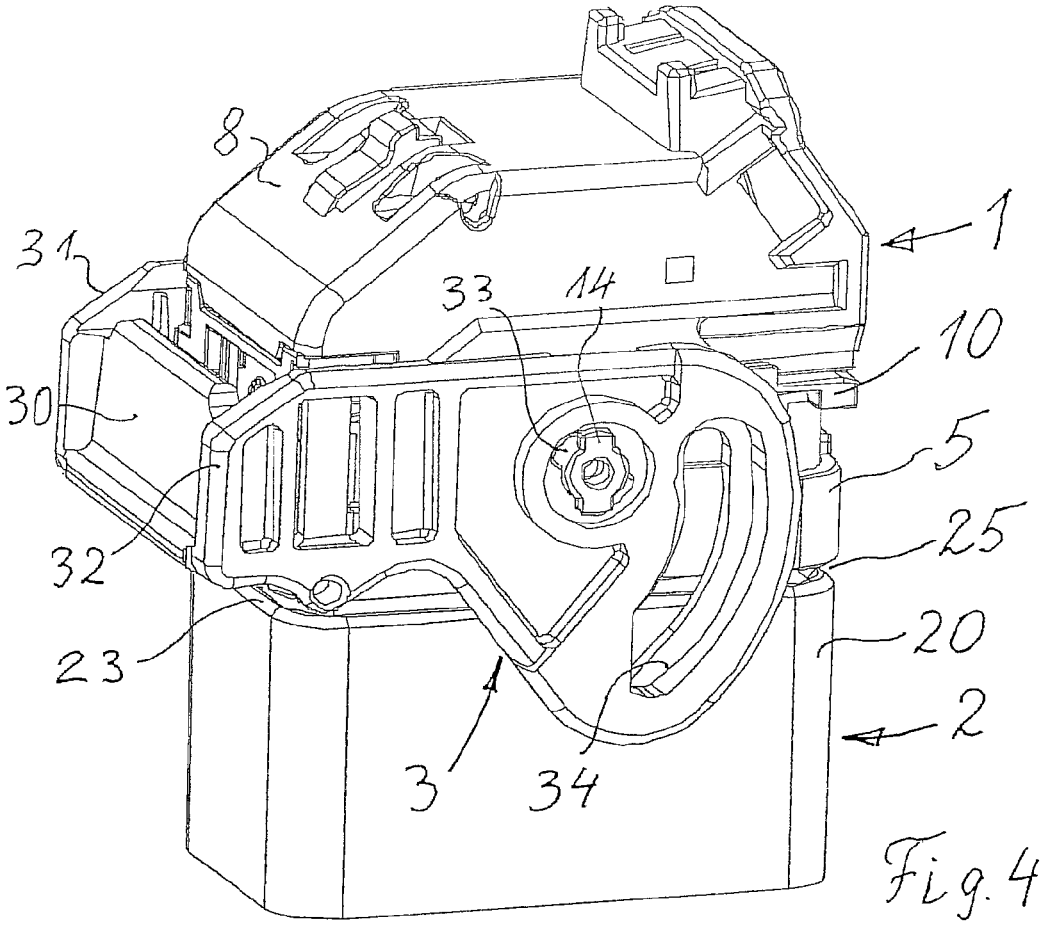
FIG. 4 shows the electrical connector completed with a wire cap and in engagement with an outer housing member of a complementary electrical connector.
Figure 5:
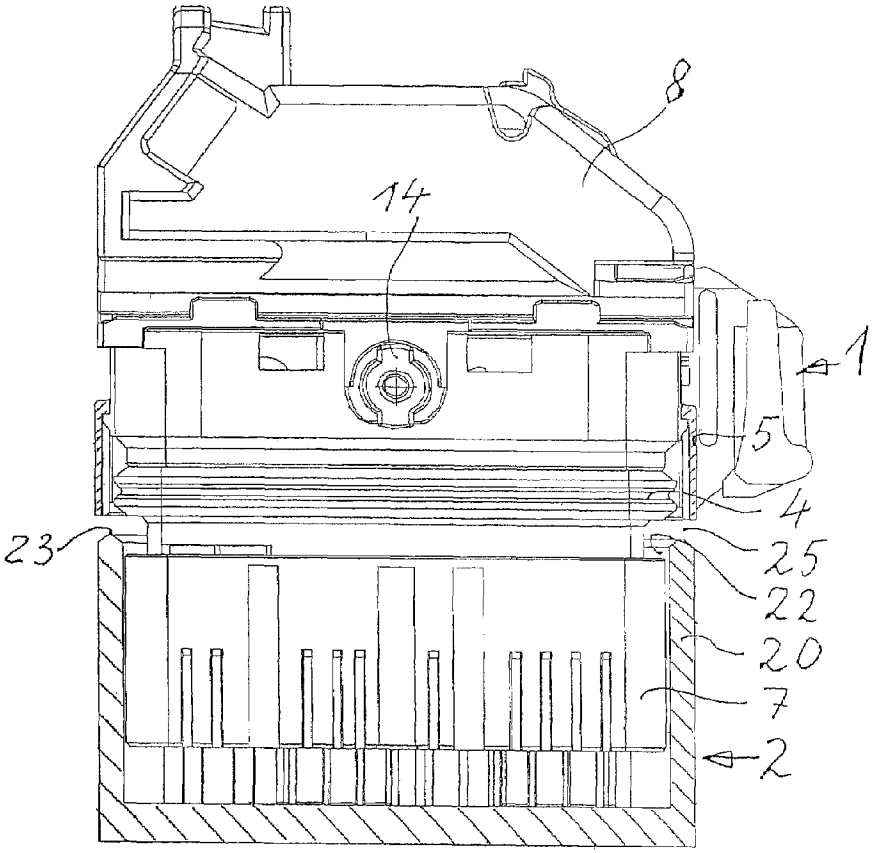
FIG. 5 is a side-elevational view with parts partly broken away.
Figure 6:
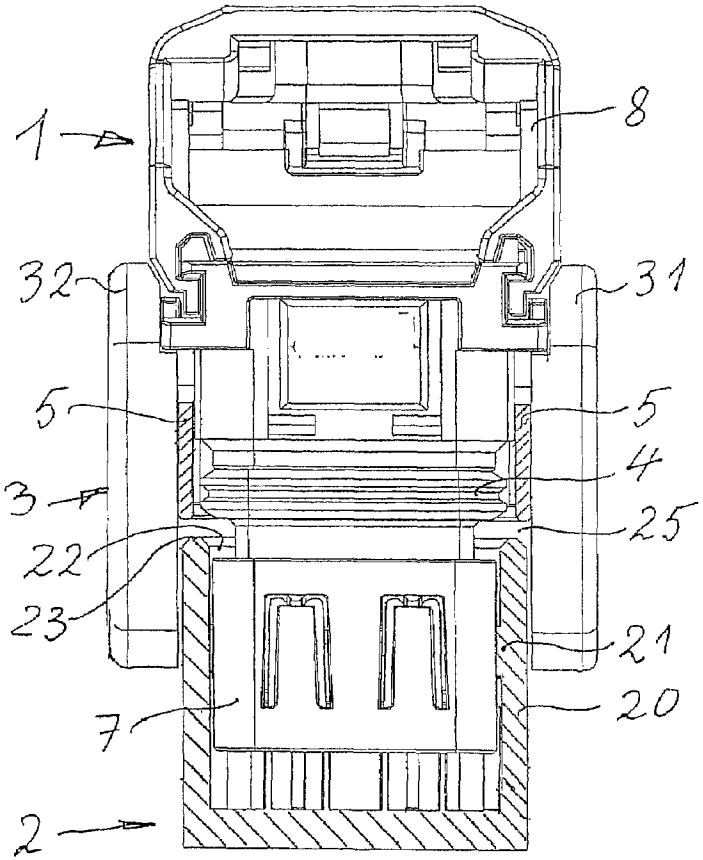
FIG. 6 is a front-sectional view also with parts partly broken away.

Referring to FIGS. 4, 5 and 6, a first, lever-type electrical connector 1 is shown in cooperation with a second, complementary electrical connector 2. This second connector 2 has an outer housing member 20 with a cog or pin projection 21 (FIGS. 8-12) on opposite sides of the housing 20, an inner rim zone 22 (FIGS. 5, 6) near the upper end of the housing 20 and a top side 23. Elements which have to do with the invention are a lever 3, an interfacial seal 4 and an annular shroud 5.

FIGS. 1 through 4 show the main assembly steps of the lever type electrical connector. The connector 1 comprises a main connector housing 10 which, in this embodiment described, has been molded together with the shroud 5 in one divisible part. Breakable links (not shown) are provided between main connector housing 10 and shroud 5 which are broken when the lever 3 is to be mounted onto the housing 10. It is self-evident that the shroud 5 could have been produced as a separate part. The housing 10 has a cavity 11 open at its upper end, and wall formations 12 at its lower end. The cavity 11 is used to take up terminals and the holding structures for the terminals as shown at 6 in FIGS. 2 and 3. These terminal holding structures 6 may include a TPA device. The wall formations 12 are used to fix the terminal pins (not shown) and will be covered by an annular body member 7 shown in FIGS. 2 and 3.

Figure 3:
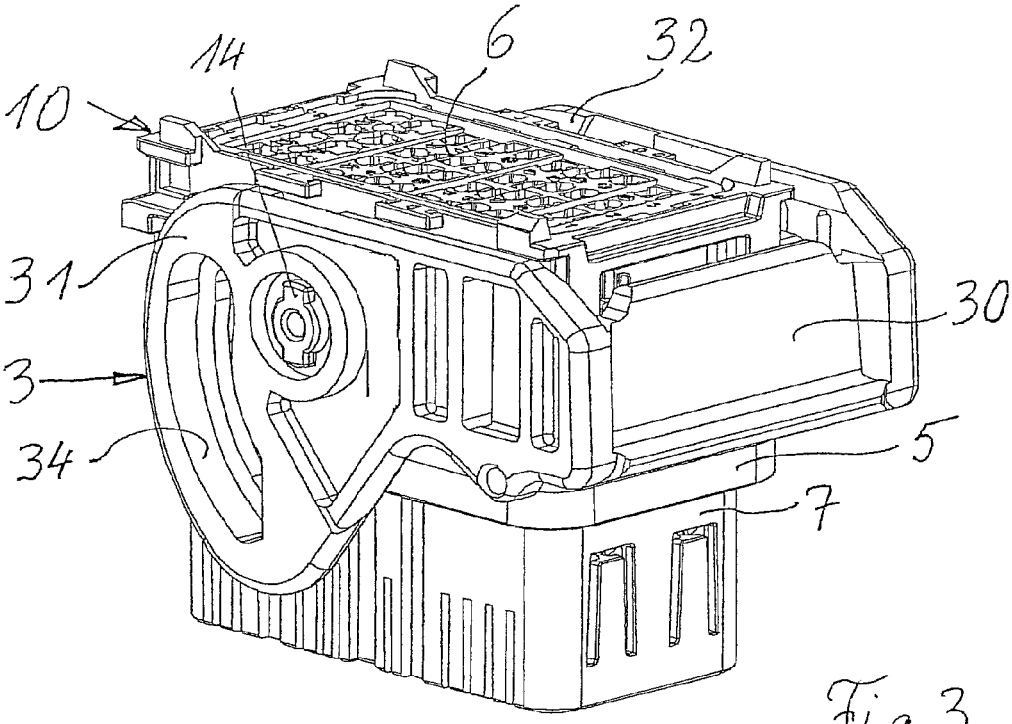
FIG. 3 shows the lever assembled to the structure of FIG. 2.

The lever 3 is of U-shaped configuration, as best shown in FIG. 3, and has two lever legs 31 and 32 connected by a bridge 30 which can be used as a handle. Both legs 31, 32 each have a keyhole-like opening 33 (FIG. 4). As shown in FIGS. 7 through 12 on each of its legs 31, 32, the lever 3 also has a curved groove 34, a curved guideway 35 and a nose 36.

Figure 1:
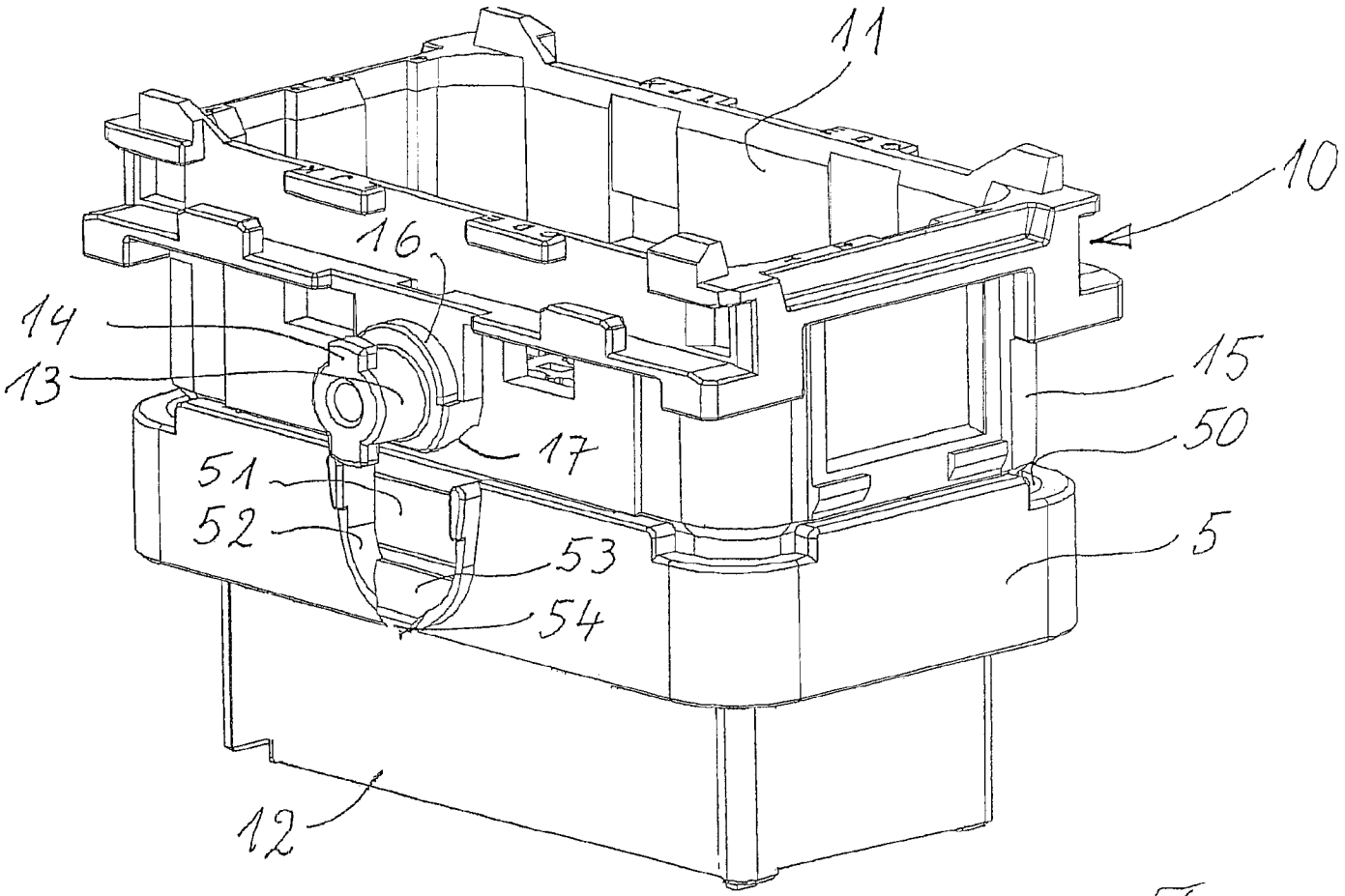
FIG. 1 is a perspective view of the main connector housing as molded together with a shroud in one divisible part.

The connector housing 10, on opposite side thereof, has a pair of pivot bosses 13 for journalling the lever 3. The keyhole-like openings 33 fit about a key-bid 14 at each end of the pivot boss 13 such that the U-shaped lever 3 can be assembled when the lever 3 and its keyhole-like opening 33 are in an angular position to register to the key-bids 14. Each pivot boss 13 has a base 16 with a cross-section shown in FIGS. 7 to 12, i.e. a smaller upper half circle and a bigger lower half circle with a flat thereon which is produced by an inclined undercut 17 (FIG. 1).

Figure 2:
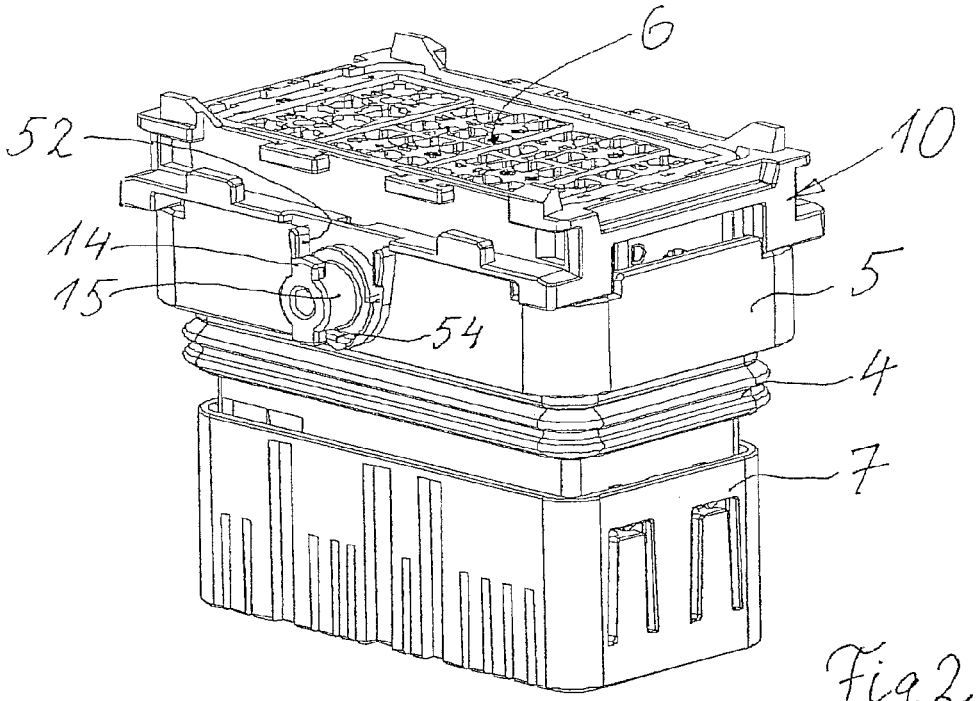
FIG. 2 shows the main housing with TPA-inserts and the shroud as well as an interfacial seal and an annular body member assembled to the main housing.

The annular shroud 5 has an inner opening 50 (FIG. 1) which fits onto an upper section 15 of the housing 10. The shroud 5 also has a cutout 51 which fits around the pivot boss base 16, when the shroud 5 is lifted from its lower position (FIG. 1) to its upper position (FIG. 2). The lateral sides of the cutout 51 are surrounded by lateral walls 52 and the lower side by an inclined surface 53 which, at its lower end, forms a cam follower 54. The cutout 51 with the lateral walls 52, the inclined surface 53 and the cam follower 54 is formed symmetrically to a vertical axis so as to be prepared to be mounted on the left or right hand side of the connector. The inclined surface 53 fits onto the inclined undercut 17 when the shroud 5 is in its upper position.

When the lever 3 is assembled as shown in FIG. 3, the parts so assembled are in a delivery condition to the harness maker who adds the wire cap 8 (FIG. 4) which includes the wires, conductors or cables to be terminated within the connector 1.

FIG. 4 also shows the electrical connector 1 mated with the complementary connector 2, also termed "header connector". As is clearly shown in FIGS. 4, 5 and 6, the protective shroud 5 does not, or essentially not, extend beyond the outlines of the header walls 20. In this manner, the protective shroud 5 does not increase the outer dimensions of the mated connector assembly 1, 2. This means a compact design of the lever-type electrical connector of invention.

Figure 7:
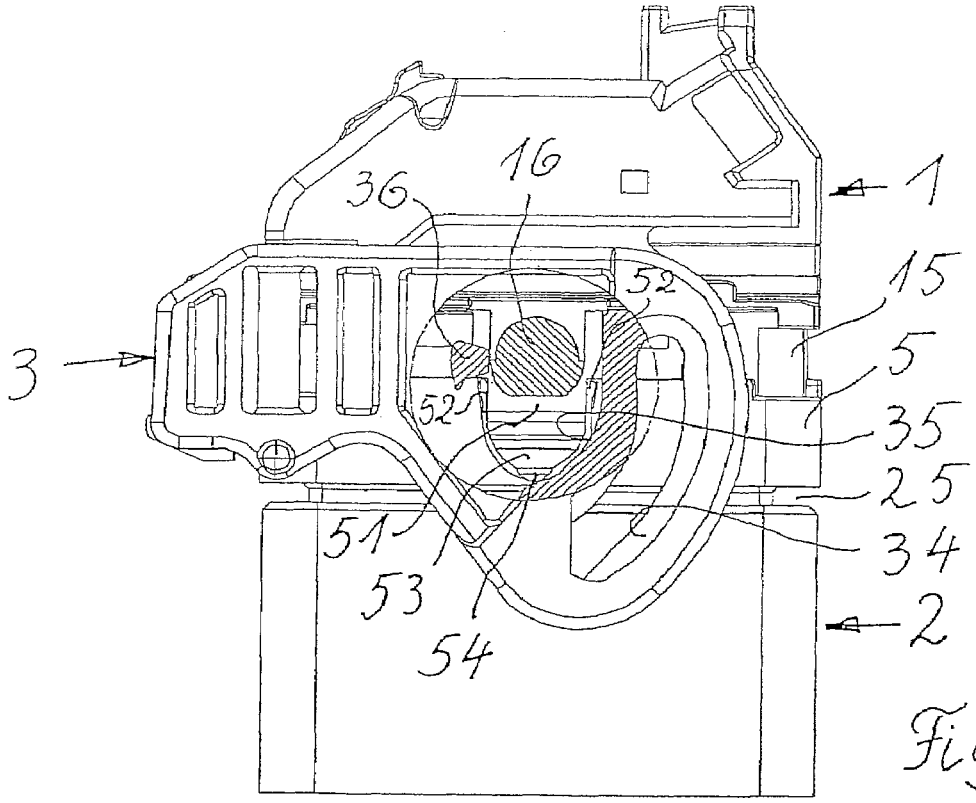
FIG. 7 is a side-elevational view of the connector, partly sectioned in the starting position of the lever.

FIGS. 7 through 12 show the mating sequence of the lever-type electrical connector 1 with the complementary electrical connector 2. In the starting position of the lever 3, the shroud 5 is in a lower position, as shown in FIG. 7, wherein the pivot boss base 16 is touching the cutout 51, and the cam follower 54 rides on the curved gateway 35. Furthermore, the projections 21 of the complementary connector 2 are in engagement with the curved groove 34 of the lever 3. In this opened position of the connector 1 on the complementary or header connector 2, the interfacial seal 4 is covered, and therefore protected, by the shroud 5, as best seen in FIGS. 5 and 6. However, there is a gap 25 between the lower end of the shroud 5 and the upper end of the housing 20.

Figure 8:
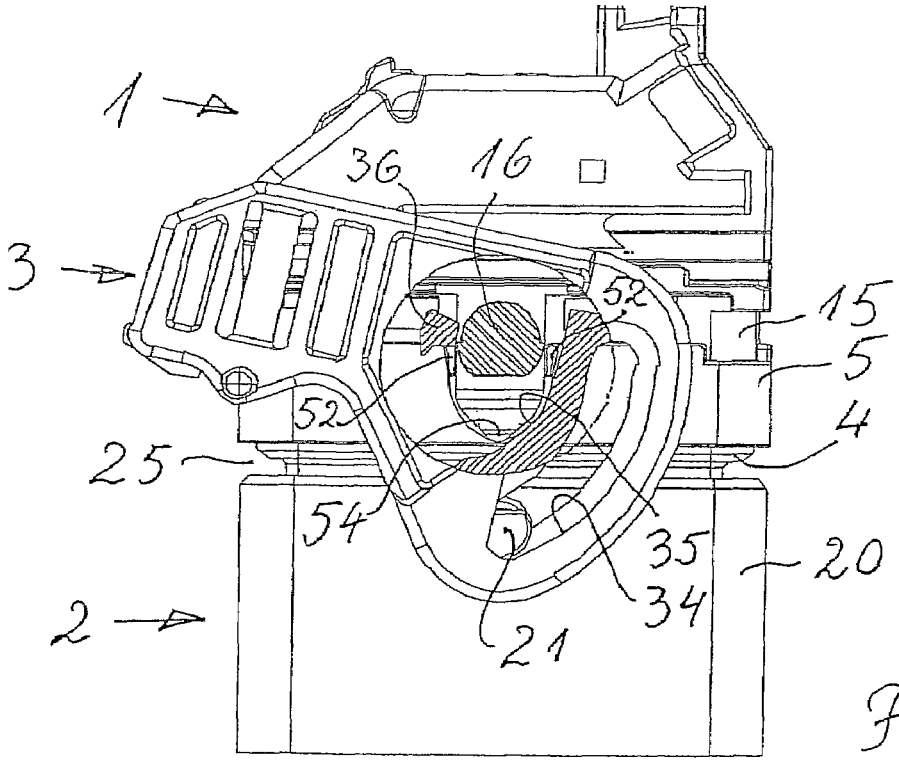
FIG. 8 is the representation of FIG. 7 with the lever beginning to lift the shroud.
Figure 9:
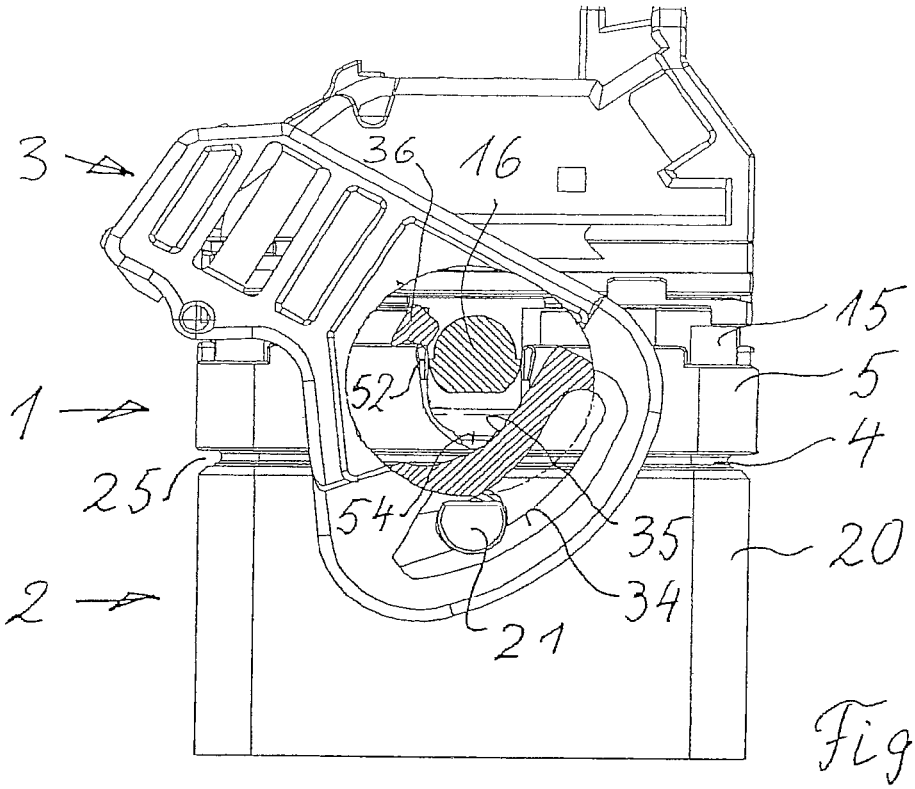
FIGS. 9, 10 and 11 show the further movement of the lever.
Figure 10:
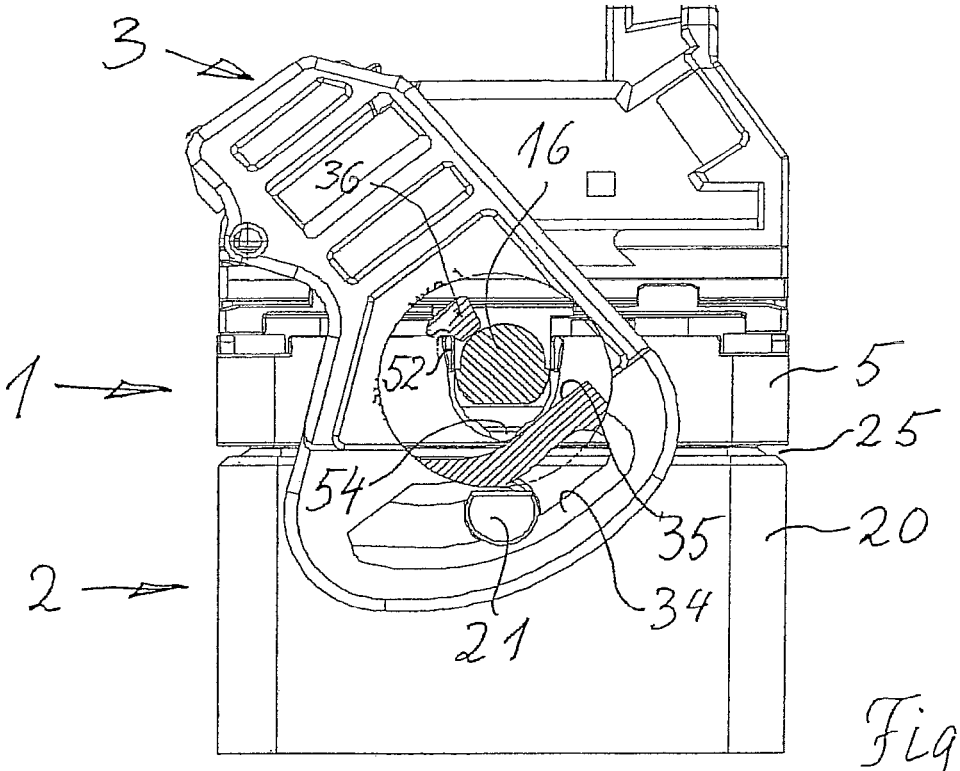
Figure 11:
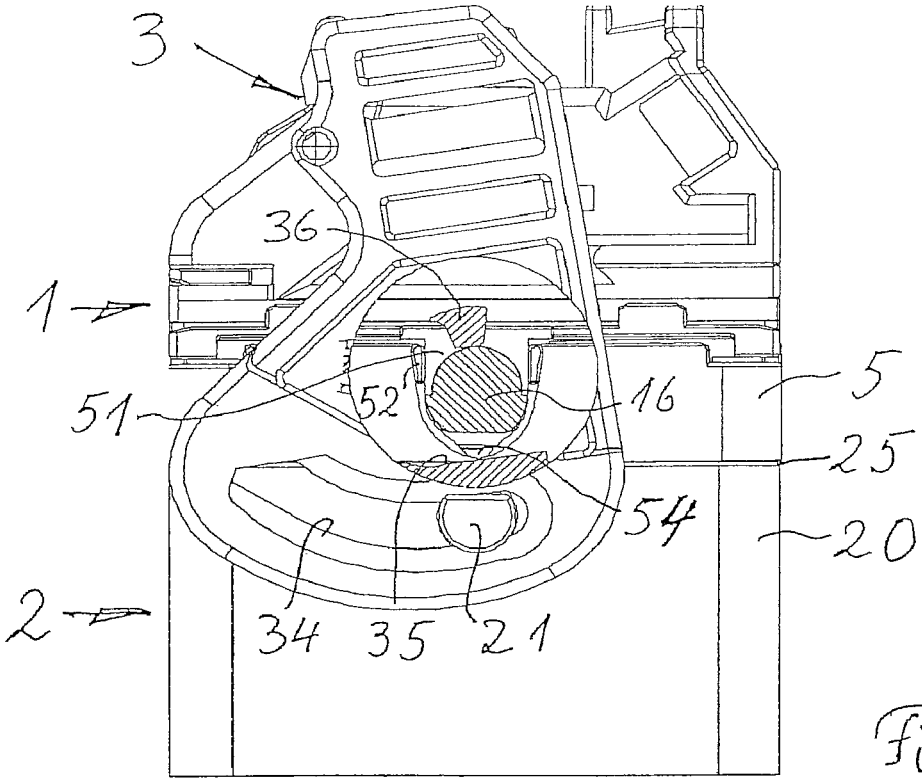
Figure 12:
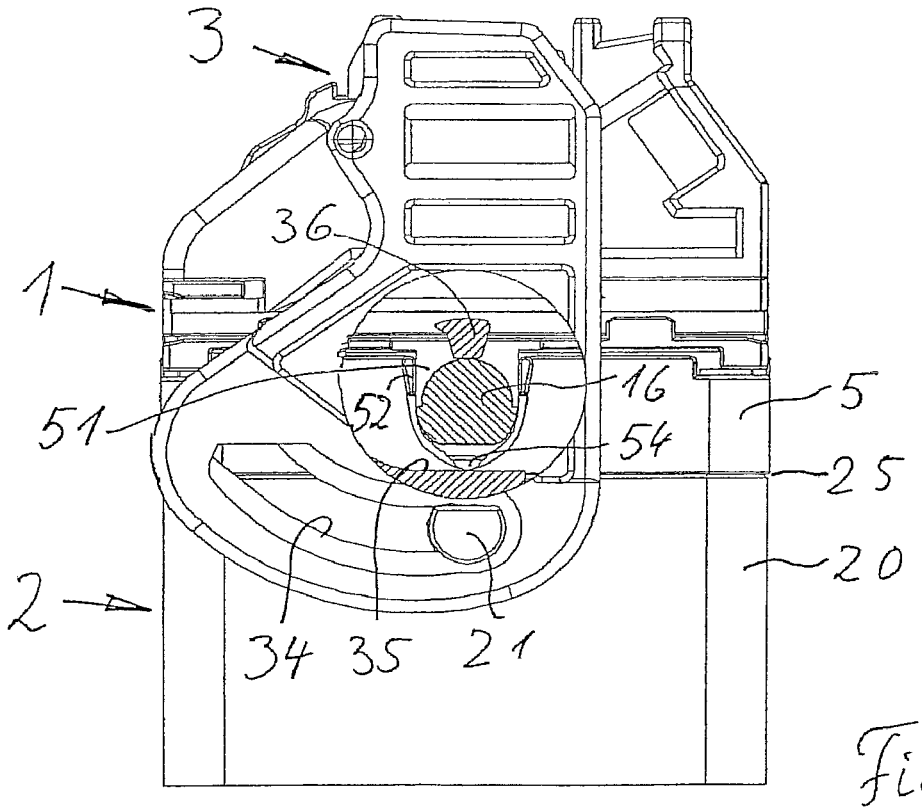
FIG. 12 shows the lever in the final blocked position.

In the first phase of rotating the lever 3 (as shown in FIG. 8) the shroud 5 begins to be lifted by the cooperation of the cam follower 54 and the gateway 35 so as to clear the seal 4 for cooperation with the inner rim zone 22 of the outer housing member 20 of the complementary connector 2. When the lever 3 is further rotated, the nose 36 rides up the upper half circle surface of the base 16 (see FIG. 10) and, due to the shape of the groove 34, the distance between the cog or pin projection 21 of the complementary connector 2 and the pivot boss 13, or base 16, diminishes so that the connectors 1 and 2 are progressively drawn together. The interfacial seal 4 gets in engagement with the inner rim zone 22 of the complementary connector 2. Simultaneously, the shroud 5 is moved relative to the outer housing member 20 of the complementary connector 2 so as to close the gap 25 between the shroud 5 and the complementary connector 2. The continuous lever rotation is shown in FIG. 8 to FIG. 12.

Figure 13:
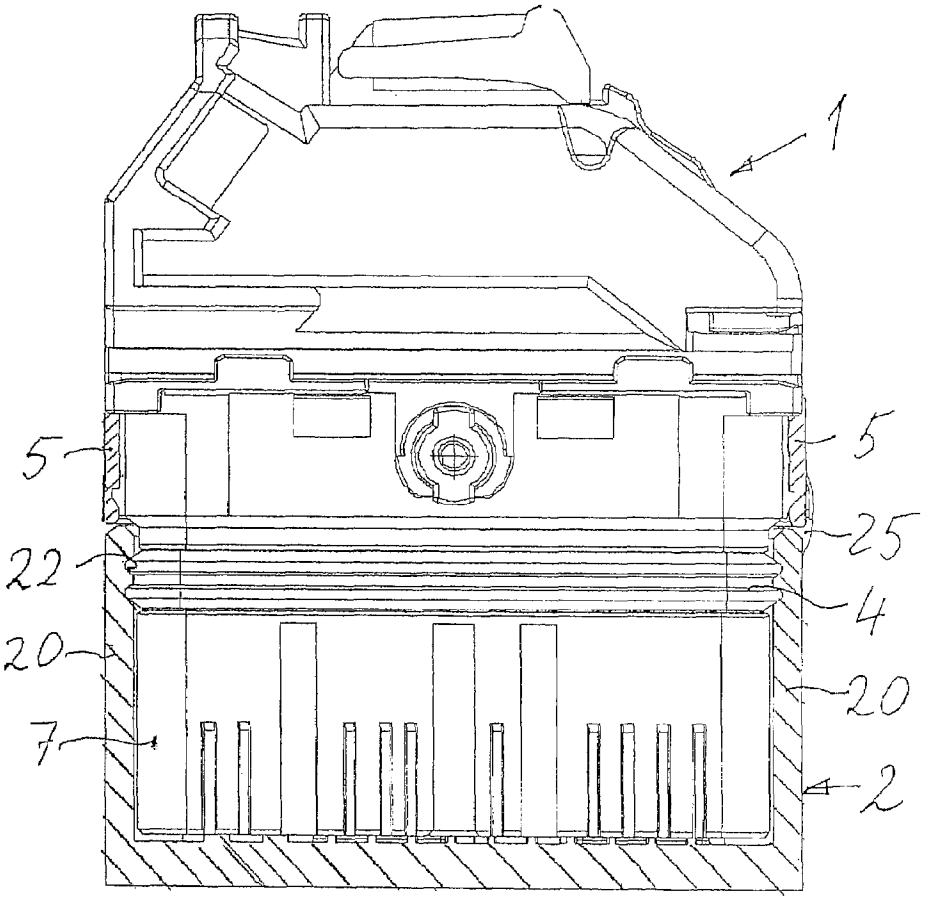
FIG. 13 is an side-elevational view of the connector, parts partially being broken away.
Figure 14:
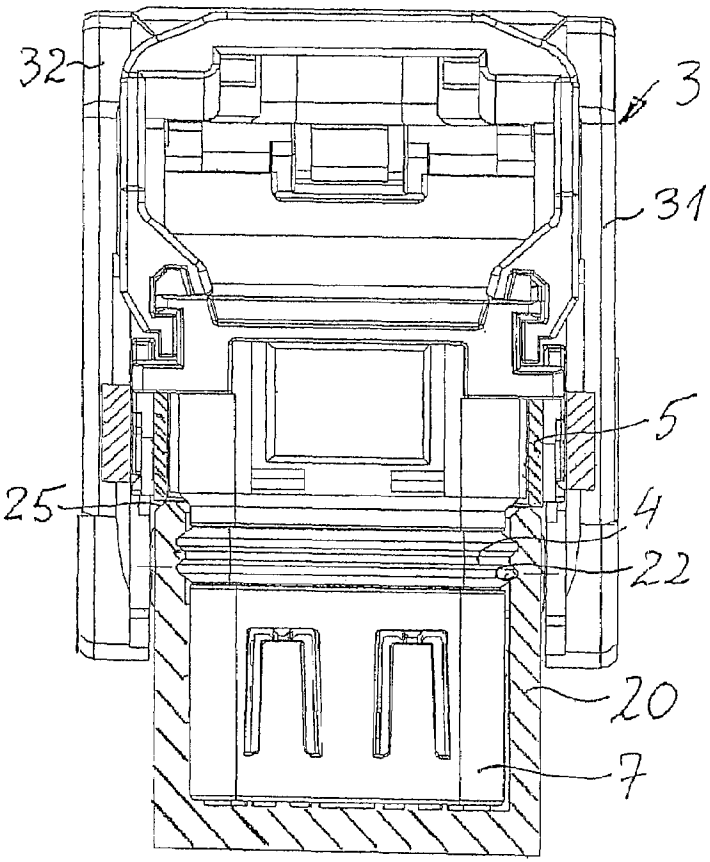
FIG. 14 is a front-elevational view of the connector also with parts partially broken away.

FIGS. 13 and 14 show the situation of both connectors 1 and 2 connected together. The interfacial seal 4 is in engagement with the inner rim zone 22 of the complementary connector 2, and the shroud 5 on the first connector 1 takes a position to close the gap 25 between the shroud 5 and the housing 20. Therefore, the interfacial seal 5 is well protected.

The unmating sequence of the connectors 1, 2 can be followed by comparing the series of FIGS. 7 through 12 backwards. By rotating the lever 3 from its final position in FIG. 12 in direction to its start position in FIG. 7, the nose 36 gets into engagement with the wall 52 of the shroud 5 and pushes the shroud 5 downwardly, disengaging from the undercut 17. By rotating the lever 3, the cooperation of the cog or pin projections 21 and the grooves 34 also leads to a separation of both connectors 1, 2 from one another. Simultaneously, the shroud 5 is shifted onto the interfacial seal 4 to protect same when the connector 1 reaches its open position in the start position of the lever 3.

It will be understood that the invention may be embodied in other specific forms without departing from the spirit or central characteristics thereof. The present examples and embodiments therefore are to be considered in all respects as illustrative and not restrictive, and the invention is not to be limited to the details given therein.

The invention claimed is:

1. A lever type electrical connector (1) comprising a connector housing (10) having a cavity (11) for accommodating terminal-receiving means (6), wall formations (12) for fixing terminal pins, the wall formations having a peripheral circumference covered by an annular body member (7), and an annular interfacial seal (4) which extends around the connector housing (10) above said wall formations (12) and said annular body member (7), said connector housing (10) also comprising a pivot boss (13) having a base (16) on opposite sides of the connector housing for journalling a lever (3) which can take a starting position for mating the electrical connector (1) with a complementary electrical connector (2), and a final position for locking both connectors (1, 2) together, characterized in that an annular protecting shroud (5) is arranged surrounding the connector housing (10) for being moved in overlapping relationship with said interfacial seal (4) to cover and protect the interfacial seal (4) when the lever-type electrical connector (1) is not mated with the complementary connector (2).

2. An assembly comprising:

the lever type electrical connector (1) of claim 1; and a complementary electrical connector (2) having an outer housing member (20) with a top side (23) on it which is configured and arranged such as to lift said shroud (5) relative to the connector (1) when the connectors (1, 2)

are mated, said outer housing member (20) having an inner rim zone (22) configured and arranged to engage said interfacial seal (5).

3. The connector according to claim 1 wherein said complementary electrical connector (2) has an outer housing member (20) with a top side (23) on it, and wherein, when said electrical connector (1) is in its starting position with the shroud (5) lowered to cover the interfacial seal (5), and is being mated with said complementary electrical connector (2), said shroud (5) is lifted relative to the connector (1) by said top side (23) of said outer housing member (20) of said complementary electrical connector (2).

4. The connector according to claim 3 wherein spring means are provided between said connector housing (10) and said shroud (5) so as to move said shroud (5) in overlapping relationship with said interfacial seal (4).

5. The connector according to claim 1 wherein said shroud (5) is coupled to said lever (3) for retracting the shroud (5) from said interfacial seal (4) when the lever (3) is rotated from its starting position into its final position, and for advancing the shroud (5) onto said interfacial seal (4), when the lever (3) is rotated from its final position into its starting position.

6. The connector according to claim 5 wherein said lever (3) has curved guideway means (35) and said shroud (5) has follower means (54) cooperating with one another to retract and advance said shroud (5) when said lever (3) is rotated in one or the other direction.

7. The connector according to claim 6 wherein said follower means (54) is connected to a wedge formation having an inclined surface (53) integral with the shroud (5), the inclined surface (53) cooperating with a bevel surface (17) on the pivot boss base (16) so as to clamp and retain the shroud (5) on place, when it is in its upper position relative to the connector (1).

8. The connector according to claim 1 wherein the shroud (5) has a cut-out (51) registering to said base (16) of the pivot boss (13) when the lever-type electrical connector (1) is mated with the complementary connector (2).

9. The connector according to claim 8 wherein said follower means (54) is in the form of a cam which is arranged below said cut-out (51) of the shroud (5).

10. The connector according to claim 8 wherein said cut-out (51) is partly surrounded by lateral walls (52).

11. The connector according to claim 10 wherein said lateral walls (52) cooperate with said pivot boss base (16) to guide the shroud (5) when moved in and out of overlapping relationship with the interfacial seal (4).

12. The connector according to claim 10 wherein said lever (3) has a nose (36) cooperating with said lateral walls (52) when the lever (3) is rotated from its final position to the start position so as to push the shroud (5) in direction to cover the interfacial seal (4).

* * * * *